US008118040B2

(12) United States Patent
Bennett

(10) Patent No.: US 8,118,040 B2
(45) Date of Patent: Feb. 21, 2012

(54) SIFTER DEVICE FOR CONTAINER

(75) Inventor: Kyle M. Bennett, Brown Deer, WI (US)

(73) Assignee: Rexam Beauty and Closures, Inc., Sussex, WI (US)

( * ) Notice: Subject to any disclaimer, the term of this patent is extended or adjusted under 35 U.S.C. 154(b) by 373 days.

(21) Appl. No.: 12/481,443

(22) Filed: Jun. 9, 2009

(65) Prior Publication Data

US 2010/0307530 A1 Dec. 9, 2010

(51) Int. Cl.
*A45D 33/02* (2006.01)

(52) U.S. Cl. ..... 132/307

(58) Field of Classification Search ..... 132/286–307, 132/314, 315, 316; 206/581, 823, 235; 220/218, 220/253, 254.1, 254.2, 254.7, 255, 781
See application file for complete search history.

(56) References Cited

U.S. PATENT DOCUMENTS 1,642,780 A 9/1927 Kole et al.
1,759,616 A * 5/1930 Heitel et al. ..... 132/306
1,794,344 A * 2/1931 Soyez ..... 132/299
1,847,949 A 3/1932 Kasdan et al.
1,895,061 A * 1/1933 Worssam ..... 132/287
7,467,727 B2 12/2008 Yuhara
7,494,030 B2 2/2009 Bennett
2006/0219256 A1 * 10/2006 Byun ..... 132/287

OTHER PUBLICATIONS

U.S. Searching Authority, International Search Report and the Written Opinion of the International Searching Authority, Search Report and Written Opinion, Aug. 10, 2010, pp. 1-12, U.S. Patent and Trademark Office, United States of America.

* cited by examiner

*Primary Examiner* — Todd Manahan
*Assistant Examiner* — Brianne Kalach
(74) *Attorney, Agent, or Firm* — Chad D. Bruggeman; John F. Salazar; Middleton Reutlinger

(57) ABSTRACT

A container for supporting particulate matter is provided. The container includes a base providing a chamber configured to receive particulate matter and a cover coupled to the base and movable relative to the base between a closed position and an open position. The container also includes a sifter supported at the base. The sifter includes a first member having at least one dispensing aperture extending therethrough and a second member having at least one dispensing aperture extending therethrough. The second member is movable between a first position in which the at one dispensing aperture of the first member is at least partially out of alignment with the at least one dispensing aperture of the second member and a second position in which the at one dispensing aperture of the first member is in greater alignment with the at least one dispensing aperture of the second member. The sifter also includes a biasing element coupled to the second member for moving the second member relative to the first member from the first position to the second position when the cover is moved to the open position.

20 Claims, 8 Drawing Sheets

SIFTER DEVICE FOR CONTAINER

BACKGROUND

The present disclosure relates generally to the field of containers for storing and dispensing materials. The present disclosure more specifically relates to containers for storing and dispensing particular matter, such as a loose powder material (e.g., a cosmetic loose powder, etc.) or any other particulate matter.

It is generally known to provide a container for storing loose powder. Such known containers typically include a receptacle for supporting the loose powder and a cover coupled to an open end of the receptacle for sealing the receptacle. Such known containers often include a sifter mechanism having a pattern of openings through which the loose powder can be dispensed. It is also known to provide a sifter mechanism comprising two or more parts, each having a pattern of openings. The parts are intended to be selectively moved relative to each other by a user in a manner that moves the patterns of opening into and out of alignment so as to move the container between an open and closed position. Such known containers are typically large and clumsy thereby making them difficult or burdensome to store in relatively limited spaces (e.g., bags, purses, pockets, etc.). Further, in known containers, the movement of the sifter mechanism is independent from the movement of the other portions of the container (e.g., the cover and/or the receptacle, etc.). As such, a user must separately actuate the sifter mechanism between the open and closed positions.

Thus there is a need for a conveniently sized container (such as a cosmetic compact) having a sifter mechanism that can substantially seal off a particulate matter, such as a loose powder, contained therein. There is also a need for a container having a sifter mechanism wherein actuation of a cover and/or base of the container actuates the sifter mechanism between an open and closed position. There is further a need for a container having a sifter mechanism to be capable of supporting an applicator used for applying a particulate matter stored within the container. The is further a need for a container for storing a particulate matter that can be moved to a latched or locked position. Accordingly, it would be desirable to provide a container capable of accomplishing any one or more of these or other needs.

SUMMARY

An exemplary embodiment relates a container for supporting particulate matter. The container includes a base providing a chamber configured to receive particulate matter and a cover coupled to the base and movable relative to the base between a closed position and an open position. The container also includes a sifter supported at the base. The sifter includes a first member having at least one dispensing aperture extending therethrough and a second member having at least one dispensing aperture extending therethrough. The second member is movable between a first position in which the at one dispensing aperture of the first member is at least partially out of alignment with the at least one dispensing aperture of the second member and a second position in which the at one dispensing aperture of the first member is in greater alignment with the at least one dispensing aperture of the second member. The sifter also includes a biasing element coupled to the second member for moving the second member relative to the first member from the first position to the second position when the cover is moved to the open position.

Another exemplary embodiment relates to a cosmetic compact. The cosmetic compact includes a base at least partially defining a cavity, a cosmetic material stowed within the cavity and a cover coupled to the base and movable relative to the base between a closed position and an open position. The container also includes a sifter supported at the base. The sifter includes a first sifter plate having at least one dispensing aperture extending therethrough and a second sifter plate having at least one dispensing aperture extending therethrough. The second sifter plate is movable between a first position in which the at one dispensing aperture of the first sifter plate is at least partially out of alignment with the at least one dispensing aperture of the second sifter plate and a second position in which the at one dispensing aperture of the first sifter plate is in greater alignment with the at least one dispensing aperture of the second sifter plate. The sifter also includes a integrally formed with the second sifter plate as a one-piece member, the spring being configured to move the second sifter plate relative to the first sifter plate from the first position to the second position when a user moves the cover to the open position.

Another exemplary embodiment relates to a method of manufacturing a container for storing and dispensing a particulate matter. The method includes providing a cover that is coupled to a base and coupling a sifter mechanism into the base. The sifter mechanism includes a first member having at least one dispensing aperture extending therethrough and a second member having at least one dispensing aperture extending therethrough. The second member is movable between a first position in which the at one dispensing aperture of the first member is at least partially out of alignment with the at least one dispensing aperture of the second member and a second position in which the at one dispensing aperture of the first member is in greater alignment with the at least one dispensing aperture of the second member. The sifter also includes a biasing element coupled to the second member for moving the second member relative to the first member from the first position to the second position when the cover is moved to the open position.

DETAILED DESCRIPTION

Figure 1:
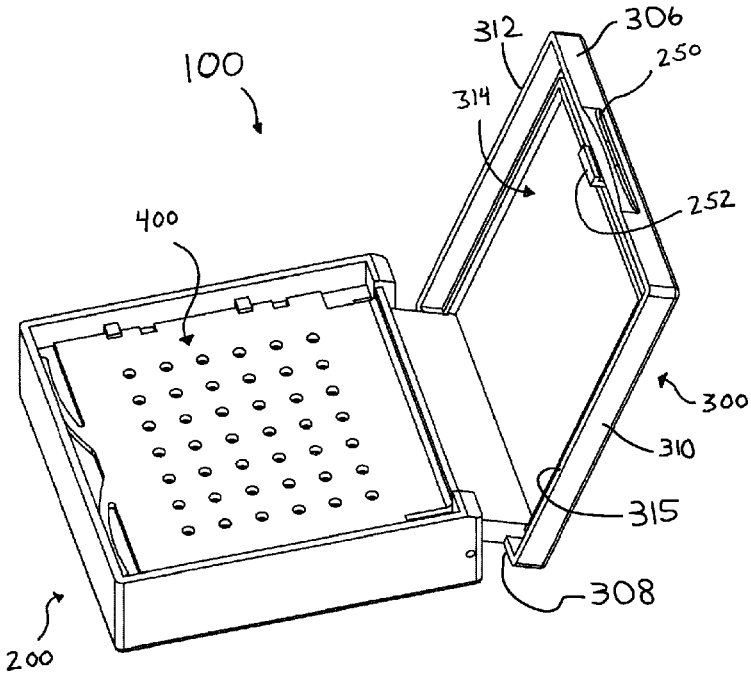
FIG. 1 is an isomeric view of a container shown according to an exemplary embodiment in an open position.

A container for storing and dispensing a particulate matter (e.g., a cosmetic loose powder, etc.) is disclosed. The container comprises a first portion (e.g., a bottom, receptacle, base, jar, etc.), a second portion (e.g., a lid, closure, top, cover, etc.) and third portion (e.g., a sifter mechanism, dispensing assembly, etc.). The first portion and the second portion cooperate to provide a conveniently sized storage system suitable for holding the particulate matter. The second portion is coupled to the first portion and is selectively movable by a user relative to the first portion between a first position in which the container is opened and a second position in which the container is closed. The third portion, which is configured to at least partially assist in controlling how and/or when the particulate matter can be dispensed from the container (e.g., the third portion may control the amount of particulate matter that is dispensed, may selectively seal off the particular matter within the container and/or may control the direction or pattern in which particulate matter is dispensed, etc.), is configured to be actuated when the second portion is moved between the first position and the second position.

According to an exemplary embodiment, the third portion comprises a first member (e.g., platform, sifter plate, etc.) and a second member (e.g., platform, sifter plate, etc.). The first member and the second member cooperate to define one or more dispensing apertures (e.g., an array or pattern of relatively small holes, etc.) through which the particulate matter is configured to be dispensed. According to an exemplary embodiment, the second member is disposed adjacent to the first member and is configured for movement relative to the first member between a first position (e.g., wherein one or more apertures in the first member are at least slightly out of alignment with one or more apertures in the second member) and a second position (e.g., wherein the one or more apertures in the first member are in greater alignment with the one or more apertures in the second member than when in the first position). According to an embodiment, the first member is coupled to the first portion in a manner that impedes the movement of the first member, at least relative to the second member.

To facilitate the movement of the second member from the first position to the second position, a biasing element is provided. The biasing element is provided for urging the second member towards the second position when a user selectively moves the second portion to the first position (e.g., when a user selectively opens the container, etc.). According to an exemplary embodiment, the biasing element is a spring that is coupled to the second member. For example, the spring may be integrally formed with the second member as a one-piece unitary body. The biasing element is moved to a loaded (e.g., compressed, etc.) state when the container is moved to the closed position. As the container is moved to the open position, the biasing element is at least partially released and acts against a portion of the container (e.g., a front portion of the second portion, etc.) for moving the second member relative to the first member to the second position. As such, inclusion of the biasing element may allow the movement of the third portion to be substantially synchronized to the opening of the container.

One advantageous feature of the third portion is that the container can provide a substantially sealed environment for particulate matter when the container is in the storage position (e.g., a closed and/or latched position, etc.). Providing a substantially sealed environment for particulate matter stored within the container may reduce the likelihood that such particulate matter will undesirably leak or otherwise spill from the container. Further, providing a substantially sealed environment for particulate matter stored within the container may assist in maintaining the freshness or effectiveness of such particulate matter. One advantageous feature of operatively coupling (e.g., linking, coordinating, synchronizing, etc.) the movement of the third portion to the movement of the second portion is that a user may simultaneously, or substantially simultaneously, move the third portion and the second portion to an opened position through a single actuation of the second portion. This may simplify opening and closing the container for a user since once the user moves the container from the closed position to the open position, the third portion is already in a dispensing position in which the particulate matter can be removed from the container. Likewise, to return the container to the closed position, a user only has to close the second portion relative to the first portion thereby causing the third portion to substantially seal the particulate matter without any additional effort on the part of the user.

It should be noted at the outset that while the container described herein will be described as a container configured to hold a cosmetic loose powder, the inventions disclosed herein have broad applicability to a variety of container. For example, the inventions disclosed herein may be suitable for with, but not limited to, containers used for holding foodstuff, cleaning products or any other container wherein it would be desirable to provide a sifter mechanism that can be controlled by the movement of the container between a closed position and an open position. Further, while the container described herein is preferably sized to fit conveniently into a user's bag, purse, pocket, etc., the present inventions are suitable for containers of any size.

Referring now to FIGS. 1 through 10, the container is shown according to a first nonexclusive exemplary embodiment as a container 100. Container 100 is shown as being a substantially rectangular (e.g., square, etc.) container comprising a first portion, shown as a base portion 200, a second portion, shown as a cover portion 300, and a third portion, shown as a sifter mechanism 400. Container 100 is configured as a cosmetic container or compact (e.g., makeup case, etc.) suitable for holding a cosmetic substance (e.g., loose powder, etc.) alone or in combination with a cosmetic accessory, tool or applicator (e.g., pad, sponge, cloth, puff pad, etc.).

Container 100 may be sized to conveniently fit into relatively small spaces (e.g., purses, handbags, pockets, briefcases, etc.). For example, container 100 (when closed) may have a width between approximately 1 inch and approximately 6 inches, a length between approximately 1 inch and approximately 6 inches, and a height or thickness between approximately 0.25 inches and approximately 2 inches. According to various alternative embodiments, container 100 may be sized larger or smaller then the dimensions provided above depending on the particular application, and may be provided in any of a variety of shapes (e.g., circular, triangular, etc.).

Figure 2:
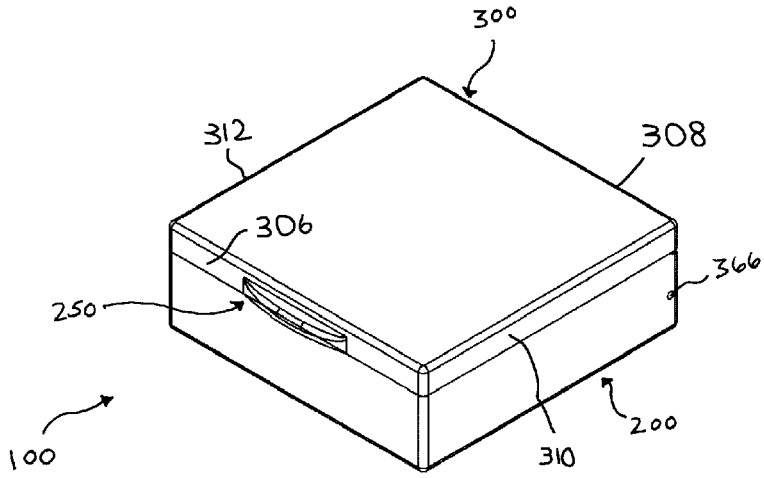
FIG. 2 is an isomeric view of the container of FIG. 1 shown in a closed position.

Container 100 is configured to be selectively moved by a user between an open position (shown in FIG. 1) and a closed position (shown in FIG. 2). According to the embodiment illustrated, container 100 is moved between the closed position and the open position by moving the cover portion 300 relative to the base portion 200 while cover portion 300 remains attached to base portion 200. According to the various alternative embodiments, cover portion 300 may be configured to be detached from base portion 200 when container 100 is moved between the closed position to the open position.

Figure 3:
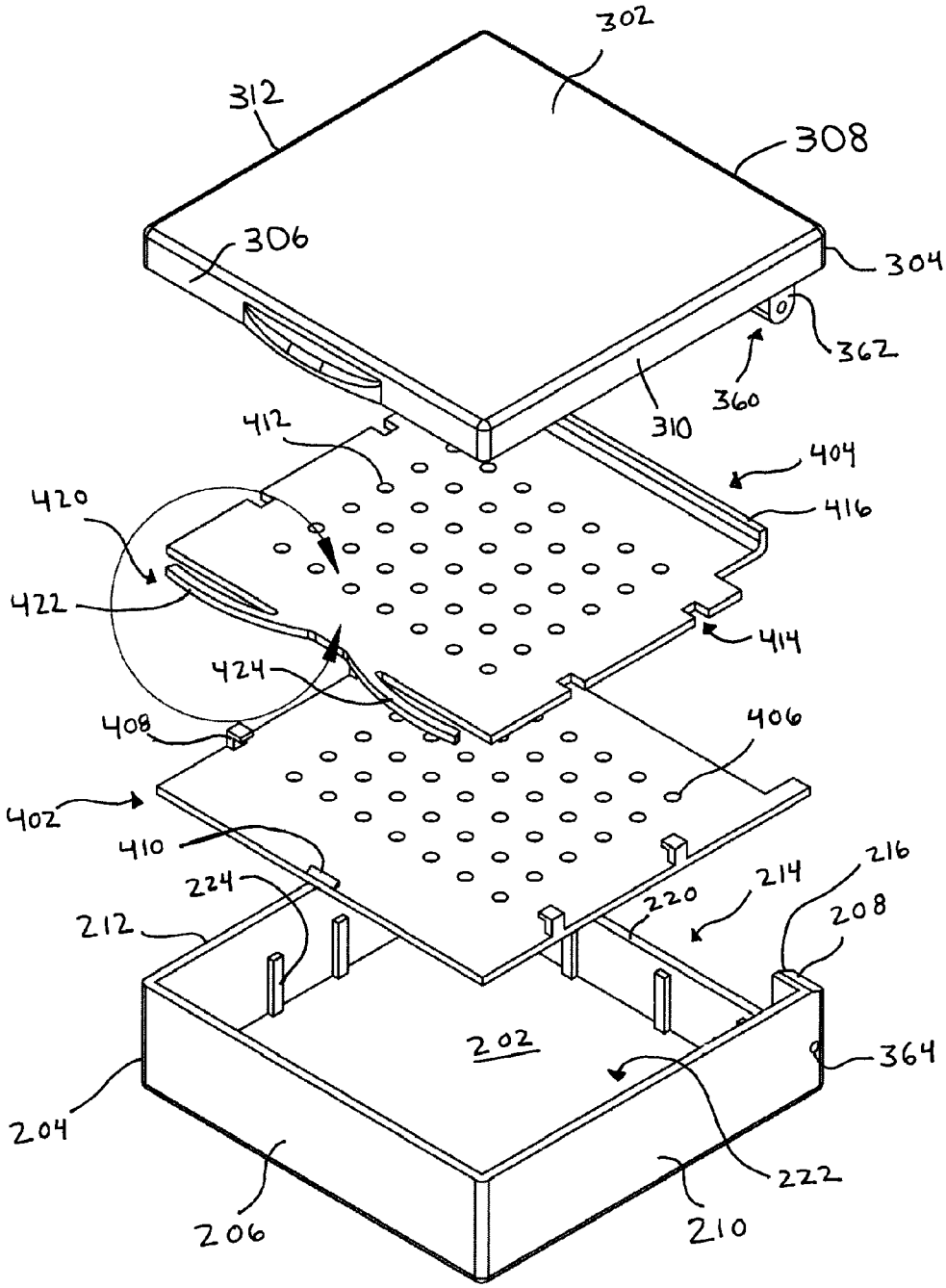
FIG. 3 is an exploded isomeric view the container of FIG. 1.

Referring to FIGS. 1 through 3, base portion 200 of container 100 is shown according to an exemplary embodiment. Base portion 200 is shown as having an end wall 202 (e.g., platform, bottom, bottom surface, etc.) and a peripheral side wall 204 extending upward therefrom at an orientation that is generally perpendicular to end wall section 202. Peripheral side wall 204 is generally rectangular in shape and at least partially defines an outer periphery of container 100. Peripheral side wall 204 is formed of a front wall 206, a rear wall 208, and side walls 210 and 212 that form an essentially square configuration. Peripheral side wall 204 may be substantially continuous (as shown), or alternatively, may comprise intermittent sections.

According to an exemplary embodiment, rear wall 208 includes a cutout portion 214 that provides clearance so that sifter mechanism 400 can be engaged by another portion of container 100 when container 100 is moved towards the closed position. According to the embodiment illustrated, cutout portion 214 is centrally located along an upper portion of rear wall 208. Cutout portion 214 is defined within rear wall 208 and is shown as being substantially continuous between a pair of side edges 216 and a bottom edge 220. Configuring cutout portion 214 in such a manner allows a portion of cover portion 300 to engage sifter mechanism 400 when cover portion 300 is coupled to base portion 200 and moved towards the closed position, while still allowing container 100 to have a substantially continuous and uniform outer appearance when in the closed position.

According to an exemplary embodiment, end wall 202 and peripheral side wall 204 are integrally formed as a single unitary body in a single mold by an injection molding operation to form base portion 200. According to various alternative embodiments, the end wall section may be coupled to the side wall section in any suitable manner (e.g., snap-fit, welding, etc.). Depending on various design criteria, the profile of end wall 202 may vary. According to the embodiment illustrated, end wall 202 is a substantially planar or flat surface. According to various alternative embodiments, end wall 202 may include portions that are convex, concave, stepped, angled, sloped, etc.

According to an exemplary embodiment, base portion 200 is configured to receive and support sifter mechanism 400. Base portion 200 supports sifter mechanism 400 at an orientation spaced apart from end wall 202 a distance sufficient to provide a chamber (e.g., opening, etc.), shown as a cavity 222, for storing the cosmetic material. The size and shape of cavity 222 may vary depending on a number of design criteria. According to an exemplary embodiment, cavity 222 has a volume between approximately 1.0 cubic inch and approximately 8 cubic inches. According to various alternative embodiments, cavity 222 may have a volume greater than or less than the range provided. Limiting the volume of cavity 222 allows the overall size of container 100 to be minimized, thereby allowing container 100 to be conveniently carried or stowed in relatively size restricted areas (e.g., pockets, purses, backpacks, etc.) by the user. According various alternative embodiments, cavity 222 may be divided into two or more compartments (e.g., storage wells, etc.) for separating multiple cosmetic materials.

To support sifter mechanism 400 in an orientation offset from end wall 202, base portion 200 includes a support member (e.g., ledge, projection, etc.), shown as a plurality of posts 224, provided along the interior of peripheral side wall 204. According to an exemplary embodiment, an upper surface of each post 224 is the surface that supports sifter mechanism 400. According to the embodiment illustrated, posts 224 are provided at a height that allows a bottom portion of sifter mechanism 400 (e.g., a first sifter plate 402, etc.) to be substantially flush with or above bottom edge 220 of cutout portion 214. Such a configuration provides an upper portion of sifter mechanism (e.g., a second sifter plate 404, etc.) with sufficient clearance to pass over bottom edge 220 as sifter mechanism moves between the first and second positions.

Still referring to FIGS. 1 through 3, cover portion 300 is shown according to an exemplary embodiment. Cover portion 300 is shown as having an end wall 302 (e.g., platform, top, top surface, etc.) and a peripheral side wall 304 (skirt, peripheral surface, etc.) extending downward therefrom at an orientation that is generally perpendicular to end wall 302. Peripheral side wall 304 is generally rectangular in shape and at least partially defines the outer periphery of the container 100. Peripheral side wall 304 is formed of a front wall 306, a rear wall 308 and side walls 310 and 312 which cooperate to form a continuous sidewall. According to various alternative embodiments, peripheral side wall 304 may comprise one or more sections providing for a discontinuous or intermittent peripheral side wall. Peripheral side wall 304 is further shown as comprising a bottom face or surface 315 (shown in FIG. 1) configured to interface (e.g., mate with, engage, contact, etc.) a corresponding structure on base portion 200. According to various alternative embodiments, peripheral side wall 304 may be adapted to fit over and/or inside a structure surrounding an open end of base portion 200 such as a flange. According to further alternative embodiments, peripheral side wall 304 may be eliminated depending on the configuration of base portion 200.

According to an exemplary embodiment, end wall 302 is orientated generally perpendicular to a central axis of peripheral side wall 304. According to an exemplary embodiment, end wall 302 and peripheral side wall 304 are integrally formed as a single unitary body in a single mold by an injection molding operation to form cover portion 300. According to various alternative embodiments, the end wall section may be coupled to the side wall section in any suitable manner (e.g., snap-fit, welding, etc.). Depending on various design criteria, the profile of end wall 302 may vary. According to the embodiment illustrated, end wall 302 is a substantially planar or flat surface. According to various alternative embodiments, end wall 302 may include portions that are convex, concave, stepped, angled, sloped, etc.

Cover portion 300 defines a cavity 314 with end wall 302 and peripheral side wall 304. According to an exemplary embodiment, cavity 314 is sized to receive an accessory, such a mirror, coupled to the underside or inner surface of end wall 302. The mirror may be coupled to the underside of end wall 302 using any of variety of suitable techniques (e.g., mechanical fasteners, adhesives, welding, etc.). According to another exemplary embodiment, cavity 314 may also be sized to at least partially receive an applicator when cover portion 300 is in the closed position that may be useful in applying a cosmetic substance stored within base portion 200. For example, cavity 314 may be sized to at least partially receive a cloth, sponge, pad, puff pad or the like that is stored within container 100 when container 100 is in the closed position.

According to an exemplary embodiment, cover portion 300 is configured to remain coupled to base portion 200 when container 100 is moved between the open and closed positions. According to the embodiment illustrated, cover portion 300 is coupled to the base portion 300 about a hinge 360.

Hinge 360 functions to allow cover portion 300 to be pivoted or rotated relative to base portion 200 between the open position and the closed position. According to an exemplary embodiment, hinge 360 generally comprises a first hinge portion 362 (e.g., projection, sleeve, knuckle, loop, joint, node, curl, etc.) provided at cover portion 300 and a second hinge portion 364 provided at base portion 300. First hinge portion 362 and second hinge portion 364 cooperate to define one or more bores configured to receive pivot rods or pins 366 that are inserted within the bores to support cover portion 300 relative to base portion 200 and to define a rotational axis about which cover portion 300 rotates relative to base portion 200. Any of a variety of known or otherwise suitable hinges may be used to pivotally couple cover portion 300 to base portion 200.

According to an exemplary embodiment, base portion 200 and cover portion 300 are formed of resins (plastic or otherwise), including, but not limited to, injection moldeable thermoplastic resin, such as acrylonitrile butadiene styrene (ABS), styrene-acrylonitrile copolymer (SAN), polypropylene (PP), polyethylene (PE), polyvinylchloride (PVC), or thermo-plastic elastomers (TPE). According to various alternative embodiments, other suitable materials (e.g., metals, bimetals, composites, wood, etc.) or combinations materials may be used to form base portion 200 and cover portion 300.

Container 100 may also include a latch mechanism to assist in retaining container 100 in the closed position. According to an exemplary embodiment, the latch mechanism may include a user interface, shown as a tab 250 in FIG. 1, provided on cover portion 300, a first latching element provided on cover portion 300 and a corresponding second latching element provided on base portion 200. According to the embodiment illustrated, the first latching element is a projection 252 that is configured to engage a corresponding recess or notch provided on base portion 200. According to the various alternative embodiments, any of a variety of latch mechanisms may be provided for selectively securing container 100 in the closed position.

Referring to FIGS. 3 through 6, sifter mechanism 400 of container 100 is shown according to an exemplary embodiment. Sifter mechanism 400 is configured to control how and/or when particulate matter stored within cavity 222 is dispensed from container 100. Sifter mechanism 400 may function as a seal that substantially prevents or restricts particulate matter from leaving cavity 222. Sifter mechanism 400 may also control the direction or pattern in which particulate matter is dispensed from container 100 and/or may control the amount of particulate matter (i.e., the flow rate) that is dispensed from container 100.

According to an exemplary embodiment, sifter mechanism 400 generally includes a first member, shown as a first sifter plate 402, and a second member, shown as a second sifter plate 404. Sifter mechanism 400 is configured to move between a first position and a second position by having second sifter plate 404 move relative to first sifter plate 402. According to the embodiment illustrated, sifter mechanism 400 is configured to substantially seal cavity 222 when in the first position such that the likelihood of leakage or spillage of particulate matter stored within base portion 200 from container 100 and/or into other portions within container 100 can be reduced. When in the second position, particulate matter stored within base portion 200 becomes accessible to a user.

According to an exemplary embodiment, first sifter plate 402 is a substantially planar (e.g., flat, etc.) member including one or more sifter openings 406 (shown as forty-two relatively small circular openings arranged in a rectangular pattern). Each of sifter openings 406 extend through first sifter plate 402 for providing a conduit through which particulate matter stored within cavity 222 can be dispensed. According to the various alternative embodiments, sifter openings 406 may have any suitable shape, size, number and pattern. For example, first sifter plate 402 may include one sifter opening or it may include two or more sifter openings, and each sifter opening may have a shape and size that is suitable to the application in which the container will be used. For example, one or more of the sifter openings may be circular, rectangular, tear-drop shaped, crescent-shaped, or one of a variety of other suitable shapes.

According to the embodiment illustrated, first sifter plate 402 is a bottom sifter plate configured to be received within base portion 200 and supported on posts 224. According to an exemplary embodiment, first sifter plate 402 is configured to be coupled to base portion 200 in a relatively fixed manner. For example, while first sifter plate 402 may be removable from base portion 200, first sifter plate 402 is generally restricted from moving (e.g., sliding, etc.) when coupled to base portion 200. While such coupling may be achieved using a snap-fit or a press-fit arrangement, other arrangements may be used including, but not limited to, an adhesive, a welding operation, a fastener, etc. According to the various alternative embodiments, first sifter plate 402 may be configured to coupled to base portion 200 in a releasable manner. Releasably coupling first sifter plate 402 to base portion 200 may allow a user to replenish (e.g., refill, etc.) cavity 222 with particulate matter.

According to an exemplary embodiment, first sifter plate 402 includes a retaining structure for securing second sifter plate 404 within container 100. According to the embodiment illustrated, the retaining structure includes one or more projections 408 provided along the lateral sides of first sifter plate 402. Projections 408 are shown as substantially L-shaped members having a first portion extending upward from first sifter plate 402 in a substantially vertical direction and second portion extending inward from a distal end of the first portion in a substantially horizontal direction. A channel defined by projections 408 in combination with a top surface of first sifter plate 402 is configured to receive and trap a portion of second sifter plate 404 (e.g., the lateral edges of second sifter plate 404) when second sifter plate 404 is assembled with first sifter plate 404. Projections 408 restrict the movement of second sifter plate 404 in a first direction (e.g., an upward vertical direction, etc.) while permitting movement of second sifter plate 404 in a second direction (e.g., front to back horizontal movement, etc.). As such, projections 408 not only provide a retaining function, but may also provide a guide function for second sifter plate 404 as it slides relative to first sifter plate 402 to move sifter mechanism 400 between the first position and the second position.

To further restrict the movement of second sifter plate 404 relative to first sifter plate 402, first sifter plate 402 is also shown as including a stop member 410. Stop member 410 is configured to limit how far second sifter plate 404 can move forward in a horizontal direction relative to first sifter plate 402. According to the embodiment illustrated, stop member 410 is an upwardly extending projection provided at a front end of first sifter plate 402.

Still referring to FIGS. 3 through 6, second sifter plate 404 is also shown as being a substantially planar (e.g., flat, etc.) member including one or more sifter openings 412 (shown as forty-two relatively small circular openings arranged in a rectangular pattern). Sifter openings 412 extend through second sifter plate 404 for providing a conduit through which particulate matter stored with cavity 222 can be dispensed when the sifter openings 412 are at least partially aligned with sifter openings 406 in first sifter plate 402. According to an exemplary embodiment, sifter openings 412 are provided in the same pattern as sifter openings 406 in first sifter plate 402. According to the various alternative embodiments, sifter openings 412 of second sifter plate 404 may have any suitable shape, size, number and pattern. Further, the configuration and/or layout of sifter openings 412 of second sifter plate 404 may be the same or different than the sifter openings in first sifter plate 402.

According to embodiment illustrated, second sifter plate 404 is an upper sifter plate configured to be supported on first sifter plate 402. Second sifter plate 404 includes an attachment structure, shown as cut-outs or notches 414, configured to receive projections 408 provided on first sifter plate 402, at least during an initial assembly of sifter mechanism 400. According to an exemplary embodiment, second sifter plate 404 includes four notches 414 that are generally rectangular in shape and configured to receive projections 208 of first sifter plate 402.

Figure 5:
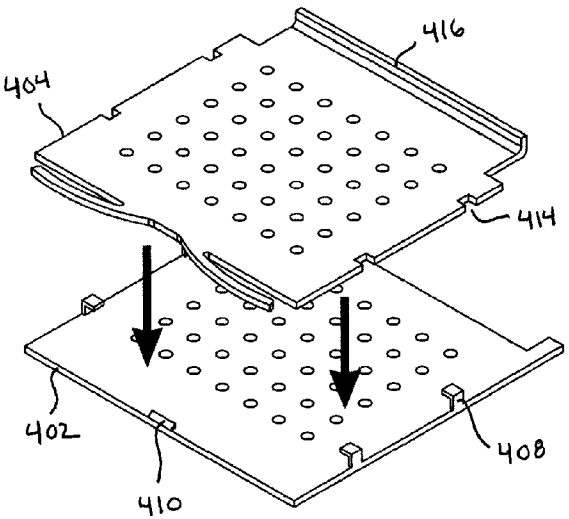
FIG. 5 is an exploded isometric view of a sifter mechanism of the container of FIG. 1.
Figure 6:
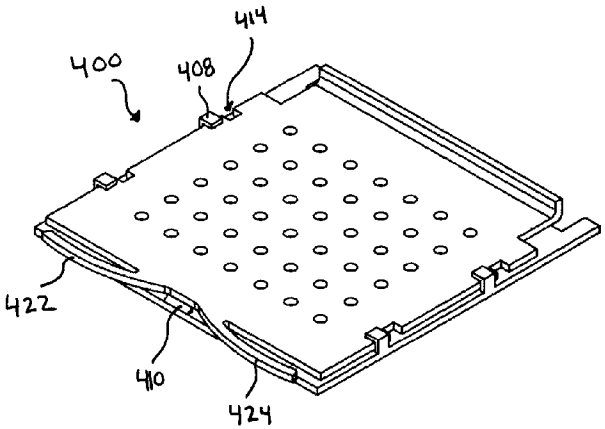
FIG. 6 is an isometric view of the sifter mechanism of the container of FIG. 1.

Referring to FIGS. 5 and 6 in particular, to assemble sifter mechanism 400, notches 414 are initially aligned with projections 408 and second sifter plate 404 is dropped in a substantially vertical direction onto first sifter plate 402. After second sifter plate 404 is dropped onto first sifter plate 402, second sifter plate 404 is moved (e.g., slid, etc.) in a substantially horizontal direction relative to first sifter plate 402 to misalign notches 414 and projections 408. For example, second sifter plate 404 may be moved in a rearward direction until second sifter plate 404 snaps over stop member 410 and is restricted from moving in a forward direction by stop member 410. With notches 414 misaligned from projections 408, second sifter plate 404 is captured by first sifter plate 402, at least in a vertical direction. During the manufacturing process of container 100, the subassembly of first sifter plate 402 and second sifter plate 404 can be installed into base portion 200 as a single unit which may provide for a more efficient assembly.

To assist in moving second sifter plate 404 relative to first sifter plate 402 when container 100 is moved to the closed position, second sifter plate 404 includes a rear wall 416 that is shown as extending in a substantially upright direction relative to the rest of second sifter plate 404. According to the embodiment illustrated, rear wall 416 is shown as being substantially perpendicular to the rest of second sifter plate 404. Rear wall 416 is configured to be engaged by a portion of cover portion 300 as container 100 is moved to the closed position. According to the embodiment illustrated, rear wall 416 is configured to be engaged by first hinge portion 362. The engagement between first hinge portion 362 and rear wall 416 causes second sifter plate 404 to slide forward relative to first sifter plate 402. According to the various alternative embodiments, rear wall 416 may be eliminated and first hinge portion 362, or another portion of cover portion 300, may be configured to engage a rear edge of second sifter plate 404.

Referring back to FIGS. 3 and 4, second sifter plate 402 also includes a biasing element for moving second sifter plate 404 relative to first sifter plate 402 so that one or more of sifter openings 412 in second sifter plate 404 are in at least partial alignment with one or more of sifter openings 406 in first sifter plate 402 when a user has selectively moved container 100 to the open position. According to an exemplary embodiment, the biasing element is a spring 420 provided at a front portion of second sifter plate 404. According to the embodiment illustrated, spring 420 is coupled to a front portion of second sifter plate 404 by being integrally formed (e.g., molded, etc.) with second sifter plate 404 to provide a unitary one-piece body. According to the various alternative embodiments, spring 420 may be coupled to second sifter plate 404 in positions other than the front portion and/or may be a separate member coupled to second sifter plate 404 using a suitable fastening technique (e.g., a fastener, press-fit, welding, adhesives, etc.).

According to an exemplary embodiment, spring 420 includes a first spring arm 422 and a second spring arm 424. First spring arm 422 and second spring arm 424 are both shown as including a first end that is coupled to second sifter plate 404 and a second end that is substantially free or unsupported. The first ends of first spring arm 422 and second spring arm 424 are shown as being coupled to a central portion of second sifter plate 404. The space separating first spring arm 422 and second spring arm 424 is the portion of second sifter plate 404 that is configured to engage stop member 410. According to the embodiment illustrated, first spring arm 422 and second spring arm 424 extend outward in opposite directions from their respective first ends and do not extend past the lateral side edges of second sifter plate 404.

Figure 4:
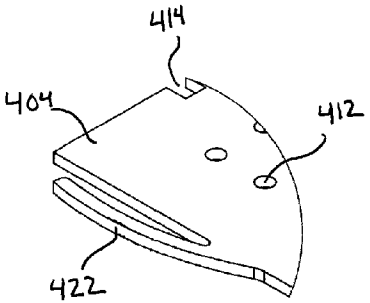
FIG. 4 is a detailed isomeric view of a sifter member of the container of FIG. 1.

Referring to FIG. 4 in particular, first spring arm 422 and second spring arm 424 have a height (e.g., thickness, etc.) that is substantially the same as the height of second sifter plate 404. Such a configuration may allow first spring arm 422 and second spring arm 424 to have a top surface that is substantially coplanar with the top surface of the portion of second sifter plate 404 that defines sifter openings 412 and/or a bottom surface that is substantially coplanar with the bottom surface of the portion of second sifter plate 404 that defines sifter openings 412.

According to an exemplary embodiment, first spring arm 422 and second spring arm 424 extend outward from their respective first ends in a curved manner. For example, first spring arm 422 and second spring arm 424 are shown as being somewhat arcuate (e.g., bow-shaped, etc.) in shape. In such an embodiment, the inner portion of the curve faces the remainder of second sifter plate 404. According to the various alternative embodiments, first spring arm 422 and second spring arm 424 may be provided in any of a variety of shapes (e.g., S-shaped, V-shaped, straight arms, etc.).

First spring arm 422 and second spring arm 424 are configured to engage an inner surface of front wall 206 of base portion 200. When container 100 is moved to the closed position, second sifter plate 404 is pushed (e.g., slid, etc.) forward relative to first sifter plate 402 to move sifter openings 412 of second sifter plate 404 out of alignment with sifter openings 406 of first sifter plate 402. As second sifter plate 404 is moved forward, first spring arm 422 and second spring arm 424 are loaded (e.g., compressed, etc.) against the inner surface of front wall 206. A space or gap behind first spring arm 422 and second spring arm 424 allows the spring arms to flex inward as they are being loaded.

First spring arm 422 and second spring arm 424 are at least partially released when the force applied to second sifter plate 404 by cover portion 300 is removed. As such, when container 100 is moved to an open position, first spring arm 422 and second spring arm 424 are at least partially unloaded or released thereby causing first spring arm 422 and second spring arm 424 to push off of the inner surface of front side wall 206. Such a reaction causes second sifter plate 404 to slide relative to first sifter plate 402 in a rearward direction so that sifter openings 412 in second sifter plate 404 are in at least partial engagement with sifter openings 406 in first sifter plate 402 and particulate matter can be removed from cavity 222. According to an exemplary embodiment, the range of movement of first spring arm 422 and second spring arm 424 is approximately 0.100 inches between the loaded and unloaded states. According to the various alternative embodiments, this range of movement can be adjusted to accommodate different applications.

Figure 7:
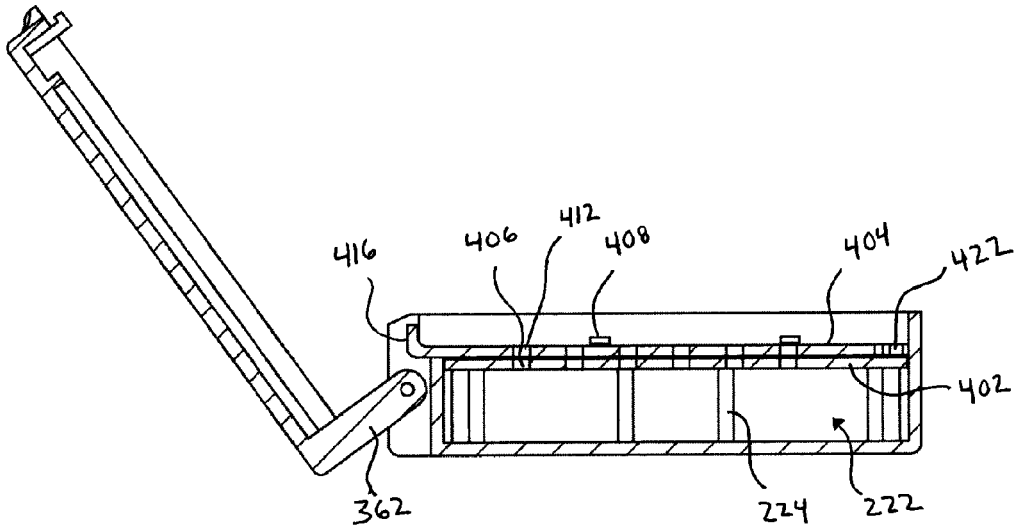
FIG. 7 is a side cross-sectional view of the container of FIG. 1 when in the open position.

With reference to FIGS. 7 through 10, the operation of container 100 will be described according to one nonexclusive exemplary embodiment. FIG. 7 shows container 100 in the open position (e.g., use position). To achieve the open position, a user must first rotate or pivot cover portion 300 about hinge 360 while holding or otherwise securing base portion 200. Before rotating cover portion 300, a user may first need to actuate latch mechanism 250 to release cover portion 300 from base portion 200.

Once in the open position, sifter openings 412 of second sifter plate 404 are at least partially aligned with sifter openings 406 of first sifter plate 402 so that particulate matter can be dispensed from cavity 222. Particulate matter can be dispensed from cavity 222 by using an applicator, such as a puff pad or cloth, that may be stored on top of second sifter plate 404. If an applicator is not provided, the user may tilt container 100 to dispense such particulate matter through one or more of the sifter openings.

Figure 8:
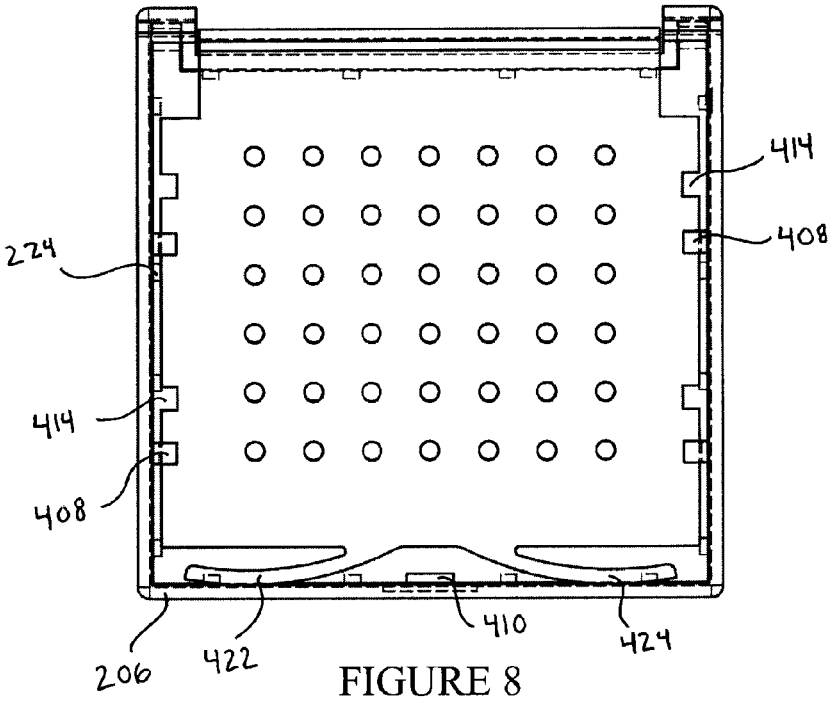
FIG. 8 is a top plan view of the sifter mechanism when the container is in the open position.

Referring to FIG. 8, in the open position, first spring arm 422 and second spring arm 424 engage the inner surface of front wall 206 to move second sifter plate 404 into this aligned position. As shown in this view, notches 414 are out of alignment with projections 408 so it is unlikely that second sifter plate 404 will become inadvertently disengaged from first sifter plate 402.

Figure 9:
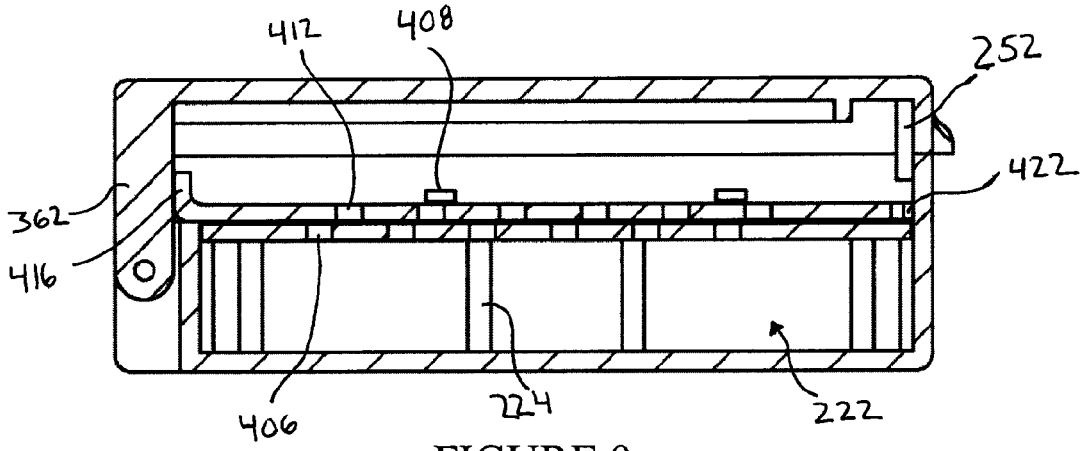
FIG. 9 is a side cross-sectional view of the container of FIG. 1 when in the closed position.
Figure 10:
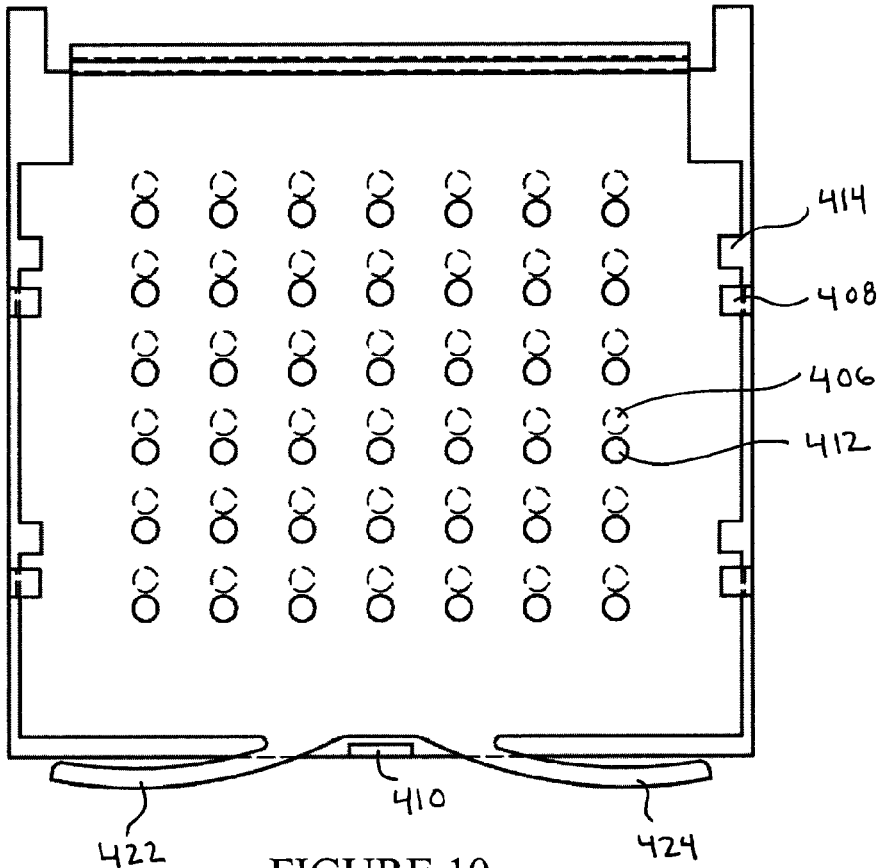
FIG. 10 is a top plan view of the sifter mechanism when the container is in the closed position.
Figure 11:
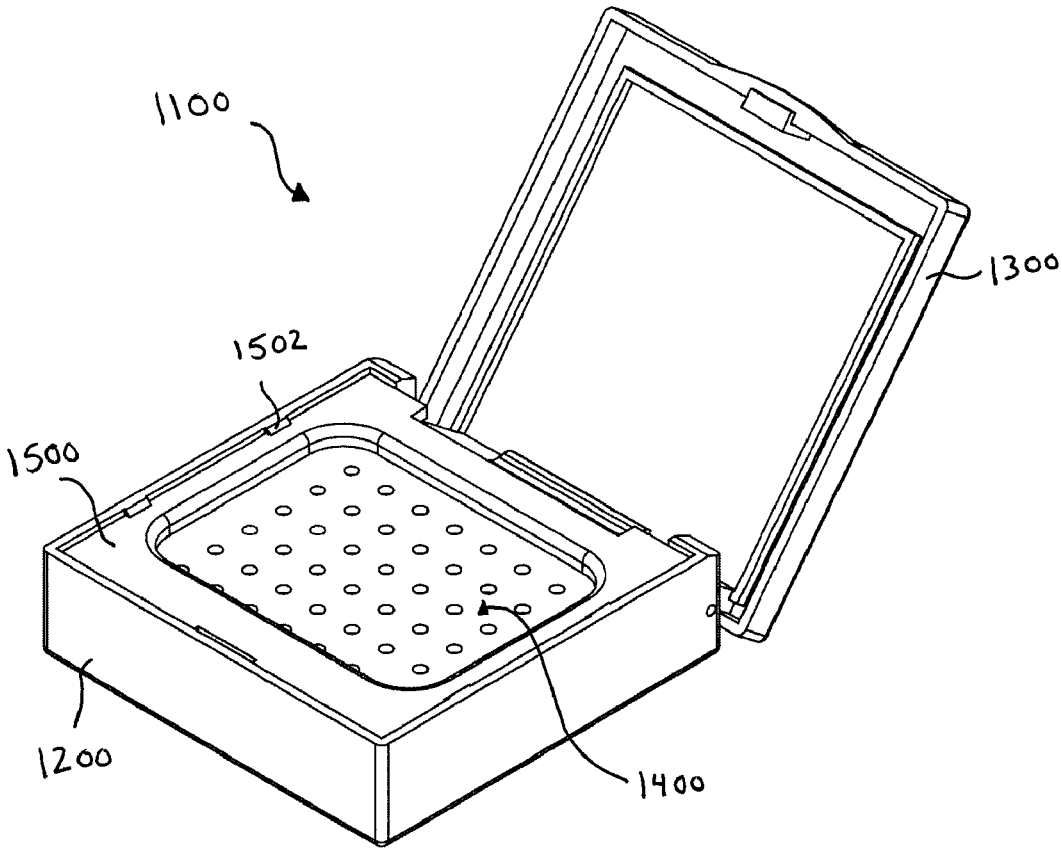
FIG. 11 is an a container shown according to another exemplary embodiment in a open position.
Figure 12:
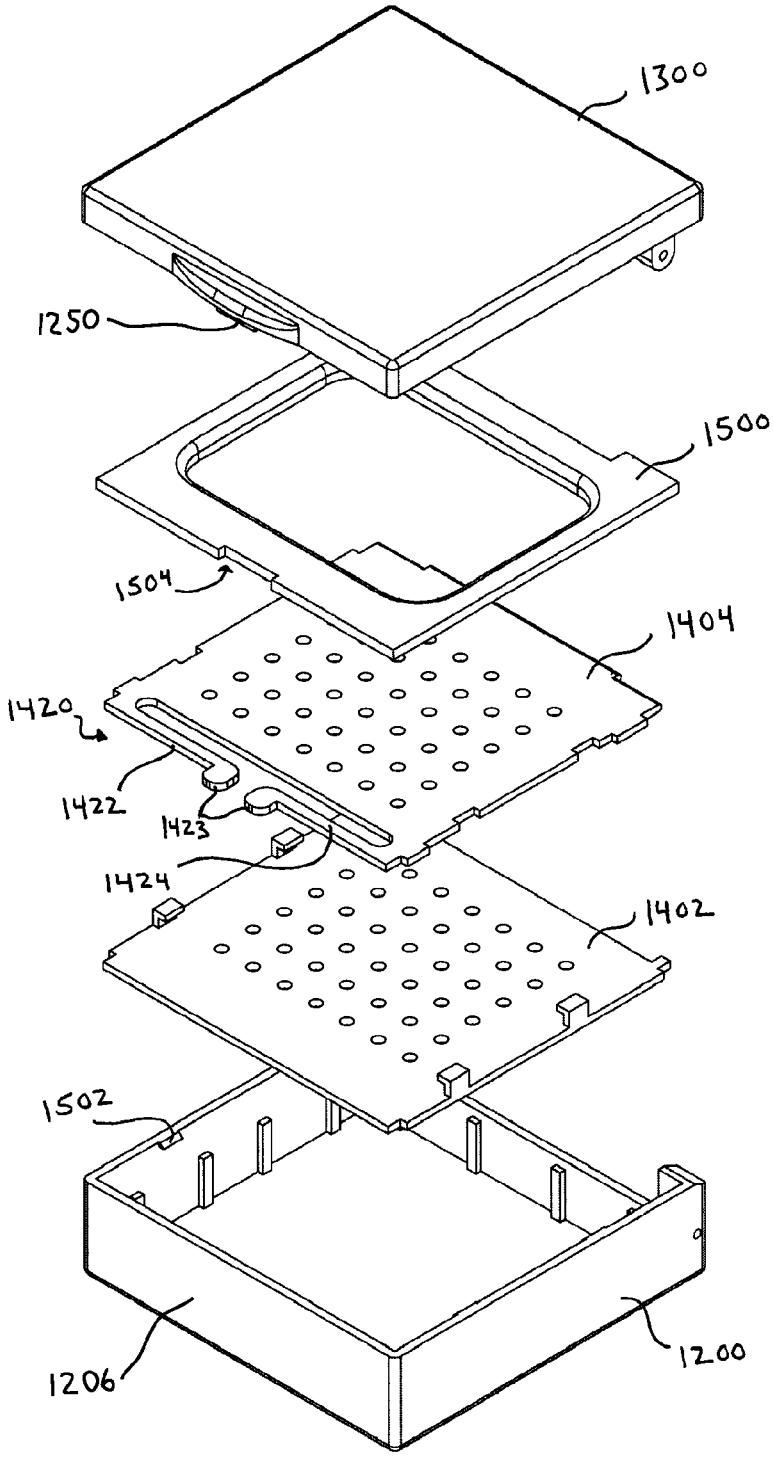
FIG. 12 is an exploded isomeric view the container of FIG. 11.

To return container 100 to the closed position, the user rotates cover portion 300 downward until latch mechanism 250 is engaged. Referring to FIGS. 9 and 10, as cover portion 300 rotates downward, first hinge portion 362 engages rear wall 416 of second sifter plate 404 and pushes second sifter plate 404 forward relative to first sifter plate 402. Second sifter plate 404 is moved forward a sufficient distance so that sifter openings 412 in second sifter plate 404 are at least partially misaligned with sifter openings 406 in first sifter plate 402. As second sifter plate 404 is moved forward, first spring arm 422 and second spring arm 424 engage the inner surface of front wall 206 and are moved to a loaded or compressed position.

In the closed position, particulate matter stored within in cavity 222 is substantially sealed off from by sifter mechanism 400. To seal off cavity, second sifter plate 404 is orientated relative to first sifter plate 402 such that sifter openings 412 in second sifter plate 404 are at least partially out of alignment with sifter openings 406 in first plate 402.

Referring to FIGS. 11 through 15, the container is shown according to a second exemplary embodiment as a container 1100. For brevity, the description of container 1100 will be generally limited to its differences relative to container 100 described above. For convenience, elements of container 1100 that are substantially similar to corresponding elements of container 100 will be identified by the same reference numerals but preceded by a "1."

Figure 13:
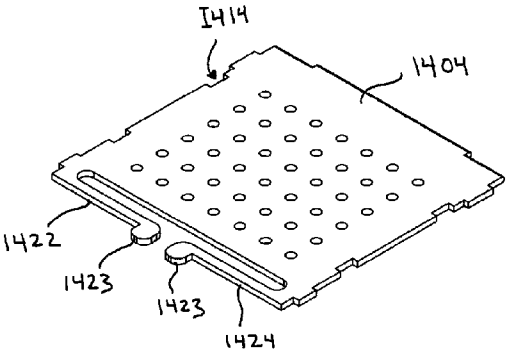
FIG. 13 is an isomeric view of a sifter member of the container of FIG. 11.

Container 1100 differs from container 100 described above in that spring 1420 provided on second sifter plate 1404 has been modified. As shown in FIG. 13, first spring arm 1422 and second spring arm 1424 are relatively straight arms that having first ends coupled to the lateral side edges of second sifter plate 1404 rather than at a central portion of second sifter plate 1404. First spring arm 1422 and second spring arm 1422 also include engagement tabs 1423 provided at their respective second ends. Engagement tabs 1423 are shown as having an increased depth relative to the remainder of the spring arms and are the portion of spring 1420 that is configured to engage the inner surface of front wall 1206.

Container 1100 also differs from container 100 described above in that container 1100 includes a trim piece (e.g., frame, etc.), shown as a bezel 1500. Bezel 1500 is configured to be coupled to base portion 1200 over sifter mechanism 1400 to trap sifter mechanism 1400. Bezel 1500 is a frame that surrounds the dispensing apertures of sifter mechanism 1400. According to an exemplary embodiment, bezel 1500 is coupled to base portion 1200 via a snap-fit by engaging projections 1502 provided on base portion 1200. According to the various alternative embodiments, bezel 1500 may be coupled to base portion 1200 using any of a variety of suitable techniques (e.g., press-fit, adhesives, welding, fasteners, etc.). Bezel 1500 includes an outer perimeter that is configured to conceal spring 1420 when installed onto base portion 1200. Such a configuration may prevent spring 1420 from becoming contaminated or unintentionally interfered with by a user. At a front portion of the outer perimeter, bezel 1500 includes an aperture or cutout 1504 that provides clearance for latch mechanism 1250.

Figure 15:
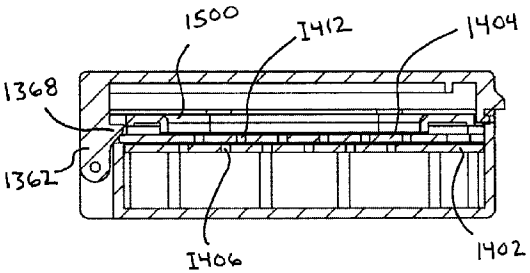
FIG. 15 is a side cross-sectional view of the container of FIG. 11 in a closed position.
Figure 14:
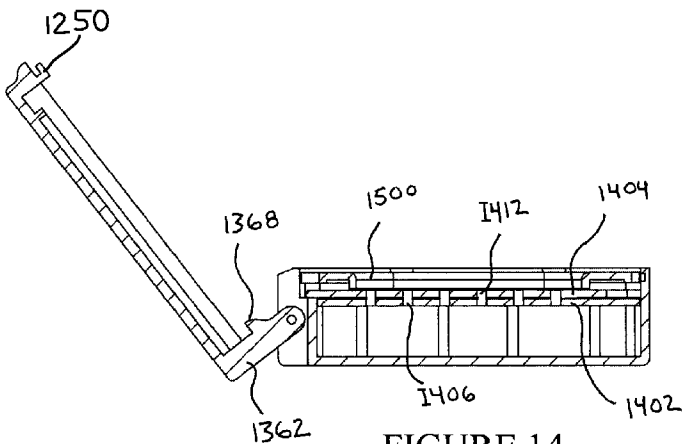
FIG. 14 is a side cross-sectional view of the container of FIG. 11 in an open position.

Container 1100 further differs from container 100 described above in that container 1100 includes a projection, shown as a tab 1368, provided on first hinge portion 1362 for engaging second sifter plate 1404. Tab 1368 includes a camming surface configured to engage second sifter plate 1404 for pushing second sifter plate 1404 in a forward direction when cover portion 1300 pivoted downward relative to base portion 1200. The camming surface is shaped to engage second sifter plate 1404 without engaging first sifter plate 1402. The engagement of tab 1368 with second sifter plate 1404 is shown in FIG. 15. According to the embodiment illustrated, second sifter plate 1404 does not include a rear wall 1416 so tab 1368 is shown as engaging a rear edge of second sifter plate 1404 rather than a rear wall.

As one of skill in the art will appreciate from the foregoing disclosure, the present disclosure relates to a number of containers wherein the movement of a cover portion is used to control the movement of a sifter mechanism. It is important to note that the construction and arrangement of the elements of the container as shown in the exemplary embodiment are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Further, the container may be configured in a wide variety of shapes to accommodate varying design criteria. According to various alternative embodiments, the container may be configured into other sizes, as well as other well-known or otherwise suitable shapes having linear and/or nonlinear edges and surfaces. For example, the container may be a generally rectangular or octagonal container. Further, for purposes of this disclosure the term particulate matter is used broadly to refer to any particulate substance (e.g., powder-like substances, granular substances, or the like, etc.) including cosmetic substances, food substances, cleaning soaps, medical substances, etc. According to various other exemplary embodiments, the container may be configured to support a fluid.

Accordingly, all such modifications are intended to be included within the scope of the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the appended claims.

What is claimed is:

1. A container for supporting particulate matter, said container comprising:

a base providing a chamber configured to receive particulate matter;

a cover pivotably coupled to said base and movable relative to said base between a closed position and an open position; and a sifter supported at said base and including:

a first member having at least one dispensing aperture extending therethrough and at least one of a projection and a notch;

a second member having at least one dispensing aperture extending therethrough and at least one of the other of said projection and said notch, said projection being configured to be inserted into said notch for assembling said second member with said first member, said second member being movable between a first position in which said at least one dispensing aperture of said first member is at least partially out of alignment with said at least one dispensing aperture of said second member and a second position in which said at least one dispensing aperture of said first member is in greater alignment with said at least one dispensing aperture of said second member;

said projection and said notch are at least partially out of alignment when said cover is in said open position; and when said cover moves from said closed position to said open position a biasing element coupled to said second member moves said second member from said first position to said second position relative to said first member.

2. The container of claim 1 wherein said biasing element is a spring that is integrally formed with said second member as a one-piece unitary body.

3. The container of claim 2 wherein said spring has a thickness that is substantially the same as a thickness of said second member.

4. The container of claim 2 wherein said spring does not substantially extend above an upper surface of said second member that defines said at least one dispensing aperture.

5. The container of claim 2 wherein said spring does not substantially extend below a lower surface of said second member that defines said at least one dispensing aperture.

6. The container of claim 2 wherein said spring is substantially coplanar with a portion of said second member that defines said at least one dispensing aperture.

7. The container of claim 2 wherein said spring includes a first spring arm and a second spring arm, said first spring arm and said second spring arm defining a front portion of said second member.

8. The container of claim 7 wherein said first spring arm and said second spring arm are configured to directly engage said base when said cover is moved to said closed position.

9. The container of claim 1 wherein said cover is pivotably coupled to said base about a hinge for movement between said closed position and said open position.

10. The container of claim 1 wherein said base includes a support surface for supporting said first member in a relatively fixed manner, said support surface being defined by a plurality of projections provided at least partially around an inner periphery of said base.

11. The container of claim 1 wherein said cover engages said second member when moving from said open position to said closed position for moving said second member from said second position to said first position.

12. The container of claim 11 wherein said second member includes a rear wall that is configured to be engaged by said cover.

13. The container of claim 12 wherein said cover includes a projection configured to engage said second member, said projection being provided on a hinge member coupled to said cover.

14. The container of claim 1 further including a latch mechanism for retaining said cover in said closed position relative to said base, said latch mechanism includes a first latching element provided at said cover and a corresponding second latching element provided at said base.

15. The container of claim 1, wherein said container is a cosmetic compact container and said particulate matter is a loose powder.

16. A cosmetic compact comprising:

a base at least partially defining a cavity;

a cosmetic material stowed within said cavity;

a cover pivotably coupled to said base and movable relative to said base between a closed position and an open position; and a sifter supported at said base and including:

a first sifter plate having at least one dispensing aperture extending therethrough;

a second sifter plate having a first planar surface and a second planar surface, said second sifter plate having at least one dispensing aperture extending between said first planar surface and said second planar surface, said second sifter plate being slidably movable between a first position in which said at least one dispensing aperture of said first sifter plate is at least partially out of alignment with said at least one dispensing aperture of said second sifter plate and a second position in which said at least one dispensing aperture of said first sifter plate is in greater alignment with said at least one dispensing aperture of said second sifter plate;

a spring integrally formed with said second sifter plate as a one-piece member, when a user pivots said cover to said open position said spring slides said second sifter plate from said first position to said second position relative to said first sifter plate; and said spring is substantially coplanar between said first and second planar surfaces of said second sifter plate that defines said at least one dispensing aperture.

17. The container of claim 16 wherein at least one of said first and second sifter plates includes at least one stopping member to limit sliding relative to each other.

18. A method of manufacturing a container for storing and dispensing a particulate matter, the method comprising:

providing a cover that is pivotably coupled to a base;

coupling a sifter mechanism into said base, said sifter mechanism including:

a first member having at least one dispensing aperture extending therethrough;

a second member having at least one dispensing aperture extending therethrough, said second member being movable between a first position in which said at least one dispensing aperture of said first member is at least partially out of alignment with said at least one dispensing aperture of said second member and a second position in which said at least one dispensing aperture of said first member is in greater alignment with said at least one dispensing aperture of said second member;

coupling said first member to said second member before the sifter mechanism is coupled to said base, thereby allowing said first member and said second member to slide relative to each other in a sliding direction and prevents relative movement in a first direction substantially perpendicular to said sliding direction; and when said cover is pivoted to said open position a biasing element coupled to said second member slides said second member from said first position to said second position relative to said first member along said sliding direction.

19. The method of claim 18 wherein the step of coupling said second member to said first member includes inserting one or more projections of at least one of said first member and said second member into one or more notches within an outer peripheral edge of at least one of the other of said first member and said second member.

20. The method of claim 19 wherein the step of coupling said second member to said first member includes first moving said second member in said first direction that is substantially perpendicular to said sliding direction to install said second member onto said first member and then sliding said second member in said sliding direction to retain said second member relative to said first member.

* * * * *